US006769676B2

(12) United States Patent
Machon et al.

(10) Patent No.: US 6,769,676 B2
(45) Date of Patent: Aug. 3, 2004

(54) APPARATUS FOR FEEDING SPINE INSERTS FOR THE MECHANICAL MANUFACTURE OF BOOK COVERS

(75) Inventors: Wolfgang Machon, Porta Westfalica (DE); Günter Geldmeier, Stemwede-Oppendorf (DE); Peter Gross, Rahden-Sielhorst (DE)

(73) Assignee: Kolbus GmbH & Co. KG, Rahden (DE)

( * ) Notice: Subject to any disclaimer, the term of this patent is extended or adjusted under 35 U.S.C. 154(b) by 428 days.

(21) Appl. No.: 09/989,236

(22) Filed: Nov. 19, 2001

(65) Prior Publication Data

US 2002/0059979 A1 May 23, 2002

(30) Foreign Application Priority Data

Nov. 21, 2000 (DE) ..... 100 57 600

(51) Int. Cl.[7] ..... B42C 7/00

(52) U.S. Cl. ..... 270/58.23; 270/52.18; 412/3; 412/17; 412/19

(58) Field of Search ..... 270/52.18, 52.01, 270/58.01, 58.05, 58.23; 412/1, 3, 5, 19, 23, 17

(56) References Cited

U.S. PATENT DOCUMENTS 2,667,909 A * 2/1954 Stobb ..... 156/444
2,922,172 A * 1/1960 Boyle ..... 156/516
2,970,634 A * 2/1961 Hantscho ..... 156/202
3,195,924 A * 7/1965 Carter et al. ..... 281/29
3,206,349 A * 9/1965 Boyle ..... 156/517
4,863,331 A * 9/1989 Torti ..... 412/3
5,127,786 A * 7/1992 Cross ..... 412/3
5,364,215 A * 11/1994 Snellman et al. ..... 412/3
5,409,341 A * 4/1995 Rathert ..... 412/17
5,413,446 A * 5/1995 Rathert et al. ..... 412/17
6,669,429 B2 * 12/2003 Beermann et al. ..... 412/19

FOREIGN PATENT DOCUMENTS

DE 36 14 167 A1 10/1987
EP 0 631 957 B1 8/2000

OTHER PUBLICATIONS

German Search Report dated Nov. 19, 2001.

* cited by examiner

*Primary Examiner*—Patrick Mackey
(74) *Attorney, Agent, or Firm*—Alix, Yale & Ristas, LLP

(57) ABSTRACT

An apparatus for feeding spine inserts for a machine for manufacturing book covers having a take-off roller system for withdrawing in clocked synchronism a material web cut to width by further means from a screening roll, having a cutting device for cutting off a portion of the material web as a flexible spine insert, having means of introducing the flexible spine insert into a board feed plane and having a board feed, which pushes the spine insert and further cover boards, for synchronous feeding of the boards onto a covering material, which has been coated with glue at a glue spreading roller and fed by means of a covering material cylinder a take-off roller system is provided, which inserts the material web counter to the board feed direction into the board feed plane and with which are associated guides for guiding the advanced spine insert and means of further guiding the cut-to-length spine insert as far as into the board feed plane. The take-off roller system is situated preferably upstream of an intermediate position of cover boards advanced in two successive strokes, so that in the region of the intermediate position a board screening feed hopper with rigid spine inserts may be disposed. The spine insert is fed jointly with the cover boards by the second stroke of the board feed to the joining point.

11 Claims, 2 Drawing Sheets

APPARATUS FOR FEEDING SPINE INSERTS FOR THE MECHANICAL MANUFACTURE OF BOOK COVERS

BACKGROUND OF THE INVENTION

The invention relates to an apparatus for feeding spine inserts for a machine for manufacturing book covers.

In book cover machines based on a horizontal processing principle [Liebau; Heinze, *Industrial Bookbinding*, Verlag Beruf+Schule, Itzehoe 1997, chapter 5.5.2; p. 399 ff], covering material fed by means of a covering material cylinder and coated with glue at a spreading roller is joined in a moving pass to linearly fed cover boards and spine inserts by means of a rolling-on operation. The book covers with the still projecting covering material edges are then transferred to a folding apparatus, by means of which the projecting edges are folded round the board edges and pressed onto the insides of the boards. Finally, the book covers are rubbed on by press rollers of a pressing station and conveyed in a delivery apparatus in stacks out of the book cover machine.

From European patent EP 0 631 957 an apparatus is known, in which portions of a spine insert running off a delivery roll are cut to length and combined synchronously, i.e. in a precisely positioned manner, with fed cover boards and glue-coated covering material in a rolling-on device. The spine insert is advanced by a pair of cutting length conveying rollers and positioned in a cutting device. A series of input roller pairs convey the cut-to-length, flexible spine insert through a conveying channel into the rolling-on device. For precise cutting and precisely positioned feeding of the spine insert, the cutting length conveying roller pair and the input rollers are driven in a clocked manner by a common, automatically controlled servomotor, wherein the cutting length conveying rollers are rendered inactive when the cut-to-length spine insert is conveyed out of the cutting position.

The apparatus is notable for a compact form of construction, which makes it possible to dispose a board screening feed hopper in an intermediate position of cover boards advanced in two successive strokes. The board screening feed hopper is required for the processing of rigid spine inserts fully trimmed on all sides, which are therefore pushed by the second stroke of the board feed synchronously with the cover boards into the rolling-on device. The board screening feed hopper, by virtue of being accommodated in the intermediate position, is highly accessible and very easy to attend. As a result of the use of the servomotor, the many driven input roller pairs and further guides, the outlay of the apparatus for feeding flexible spine inserts is relatively high.

In another known book cover machine based on a horizontal processing principle, the cut-to-length, flexible spine insert is deposited in the intermediate position of the board feed in that the spine insert, after being cut to length, is pushed by roller pairs, deflection devices and further guides in board feed direction into the board feed plane. The flexible spine insert is fed by the second stroke of the board feed to the rolling-on device. With said apparatus, however, there is no longer space to accommodate a board screening feed hopper, which therefore has to be accommodated between the cover boards stocked in a board feed hopper. The spatial conditions are confined and attendance, especially for the purposes of restocking and fault elimination, is made difficult. Particularly in the case of large format lengths, the trailing edge of the spine insert lies so far in front of the board pusher that the latter encounters the stationary spine insert at high speed, which in the case of wide, thin spine inserts leads to stiffness problems.

SUMMARY OF THE INVENTION

The object of the invention is to create an apparatus of the described type, which in a simple, attendance-friendly manner enables the precisely positioned and operationally reliable combining of flexible spine inserts with cover boards and covering material.

The flexible spine insert is brought counter to board feed direction into a position within the board feed plane, from which board pushers of the board feed take over the spine insert and combine it in a precisely positioned manner with the cover boards and the covering material. The trailing edge, at which the spine insert is pushed, lies for every format length immediately in front of the forward- and backward-moving board pusher, which is waiting in the rear reversing position, so that the board pusher encounters the spine insert at a relatively low speed.

According to an advantageous development, the spine insert may be pushed directly between the cover boards of the board feed hopper. This therefore offers the possibility of specially aligning not just the cover boards but also the spine insert by means of the board feed, which in two successive strokes slides forward over an intermediate position. On the other hand, the second stroke may be redundant if the cover boards and the spine insert are fed from the board feed hopper in one stroke directly to the joining point.

Another advantageous development provides that the feed be provided upstream of the intermediate station so that the flexible spine insert is simultaneously driven out of the intermediate station by the board pushers. Besides good accessibility of the feed of the flexible spine insert, there is also the possibility of placing the board screening feed hopper for rigid spine inserts above the intermediate station. The then separate feed hoppers for cover boards and rigid spine inserts may be of a far simpler design and the restocking of spine inserts in the feed hopper as well as the elimination of any faults which arise may be carried out easily and quickly.

The adaptation of the guides to the different thicknesses of the spine inserts is advantageously effected by exchanging suitably designed interchangeable parts. As a rule, one set of guides for flexible (=thin) spine inserts and one set of guides for rigid (=thick) spine inserts are required.

BRIEF DESCRIPTION OF THE DRAWINGS

An embodiment of the invention is described in detail with reference to the drawings. The drawings show.

DETAILED DESCRIPTION OF THE PREFERRED EMBODIMENT

Figure 1:
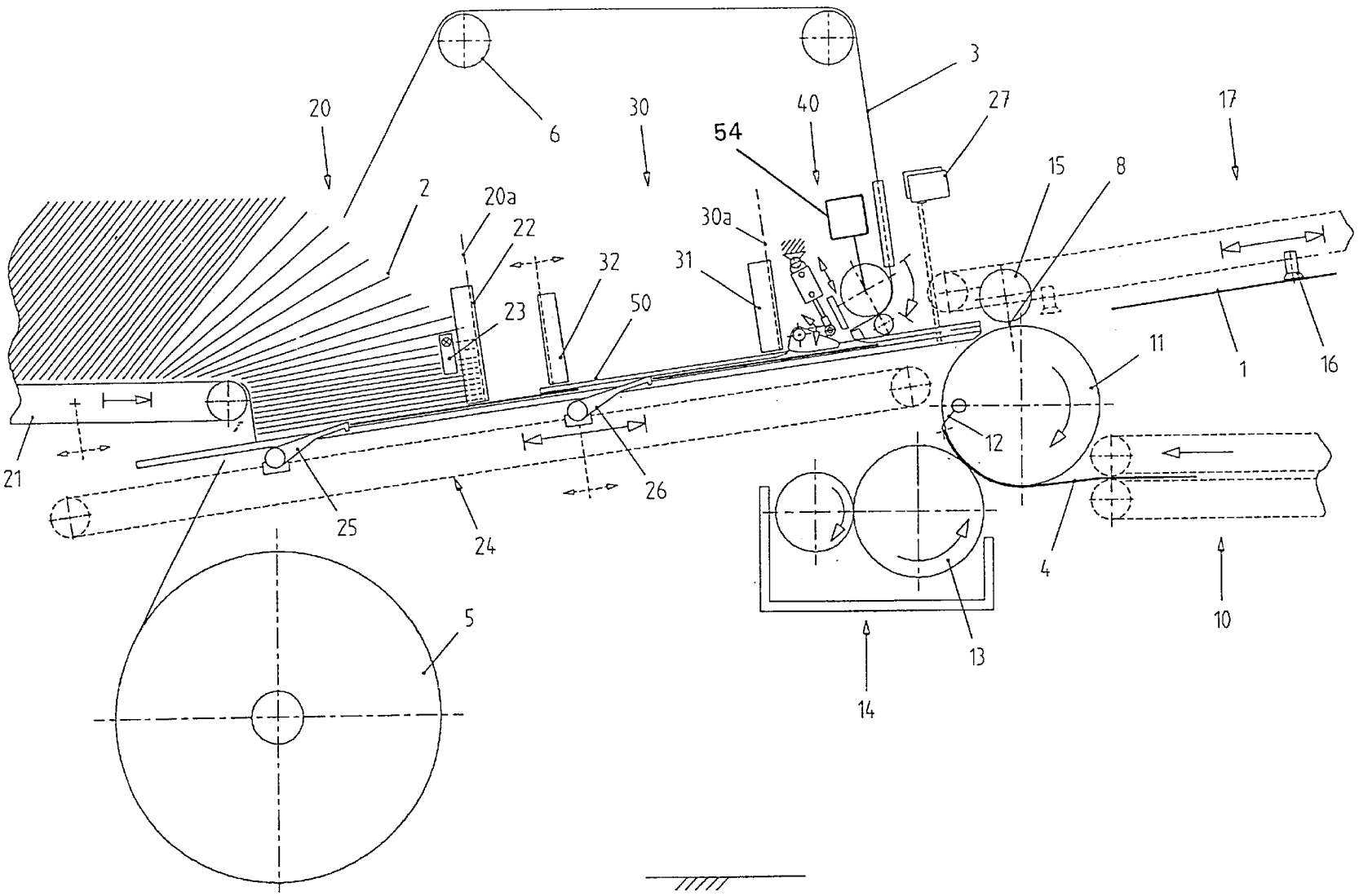
FIG. 1 is a side view of an apparatus for feeding spine inserts in a book cover machine.

FIG. 1 shows in a simplified view a detail of a book cover machine, in which book covers 1 are manufactured by assembling cover boards 2 and spine inserts 3 or 7 on covering material 4. The covering material 4 is fed by a known covering material feed 10 (not shown in detail here) to a covering material cylinder 11, by means of which the covering material 4 is taken over by grippers 12, conveyed past a spreading roller 13 of a gluing mechanism 14 and rolled at the joining point 8 onto the synchronously fed cover boards 2 and spine inserts 3 or 7. Pressure rollers 15 in said case press the boards 2, 3 or 7 onto the covering material 4, while a reciprocating suction crosspiece (16) takes over the book cover 1 in order to feed the latter to a folding and pressing station 17, which is not shown here.

The cover boards 2 are conveyed by a prestacking belt 21, which is controlled by a light barrier 23, into a board feed hopper 20. In the board feed hopper 20 the cover boards rest against stops 22, which are associated with a format-defined reference edge 20*a* and may be adjusted to the width of the cover boards 2. For different heights of the cover boards 2 the prestacking belt 21 is displaced accordingly. A first board pusher 25 pushes in each case the lowermost cover boards 2 out of the board feed hopper 20 and feeds them to an intermediate station, from where they are fed by a second board pusher 26 to the joining point 8. The board pushers 25, 26 are moved forwards and backwards by a toothed belt 24, wherein the height of the cover boards is taken into account by phase displacement of the drive of the toothed belt 24 as a format adjustment.

The spine inserts 3 or 7 may be used as a flexible spine insert 3, so-called endless screening, or as a rigid spine insert 7, also known as board screening, and are fed by the second board pusher 26 jointly with the cover boards 2 to the joining point 8, wherein the cover boards are aligned at outer guides 53 and the spine insert 3 or 7 are advanced in guides 50. The guides 50 substantially comprise a base 51, on which the spine insert 3 or 7 and the cover boards 2 are supported by outer edge regions, and guides 52*a, b*, which are designed as interchangeable parts and are exchanged in accordance with the thickness of the spine insert 3 or 7 to be processed. The guides 50, 53 are designed so as to be adjustable in accordance with the format of the book cover 1. The board feed is monitored immediately upstream of the joining point 8 by light barriers 27.

Figure 2:
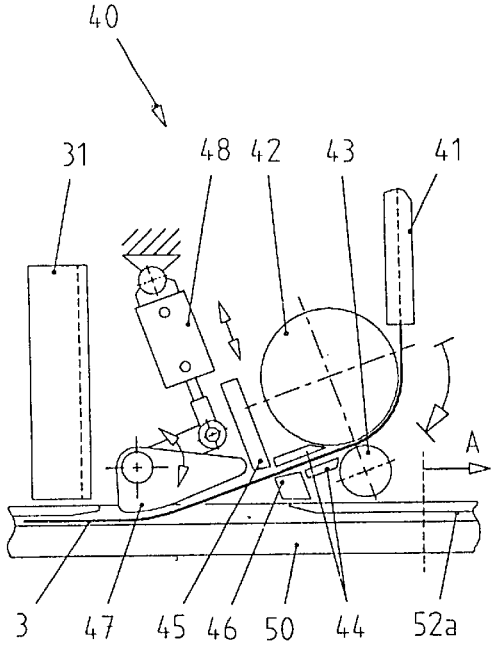
FIG. 2 is an enlarged detail of the apparatus, where the apparatus is pushing a flexible spine insert withdrawn from a screening roll into the board feed plane.
Figure 3:
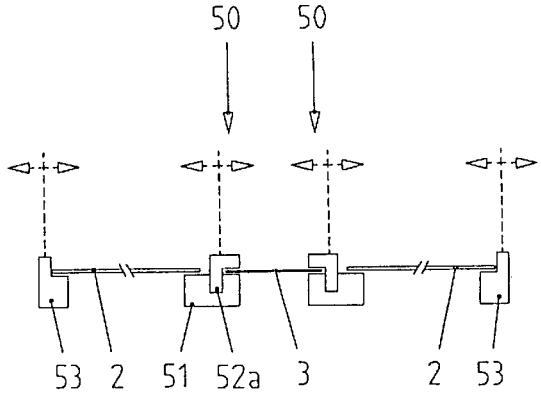
FIG. 3 is a view of the apparatus in accordance with the direction A shown in FIG. 2.
Figure 4:
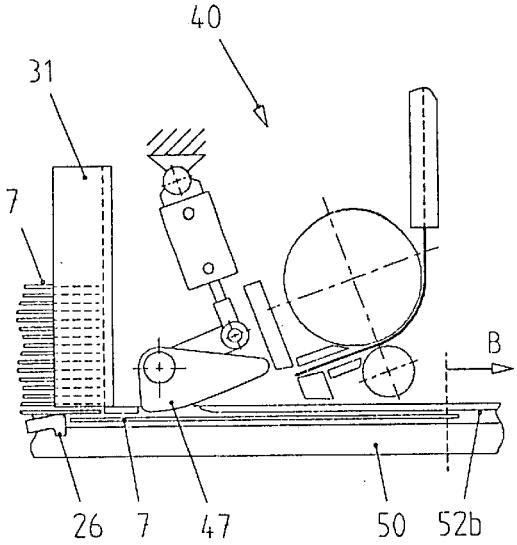
FIG. 4 is an enlarged detail of the apparatus, where a board pusher is advancing a rigid spine insert decollated from a board screening feed hopper through under the screening guide for joining.
Figure 5:
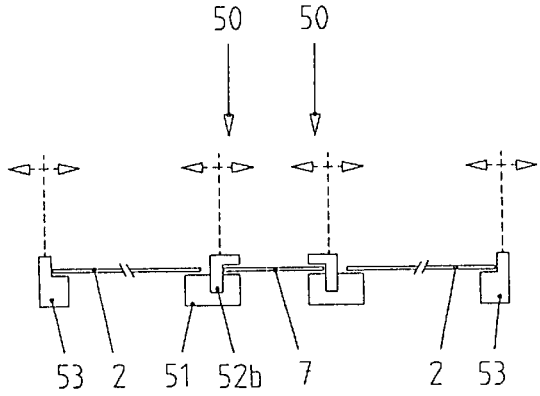
FIG. 5 is a view of the apparatus in accordance with the direction B shown in FIG. 4.

The flexible spine insert 3 is inserted by a screening feed 40 into the guide 50, namely in the opposite direction to the actual push-out direction of the boards 2, 3 or 7. To said end, a material web of the spine insert 3 is withdrawn from a screening roll 5 via deflection pulleys 6 and while being aligned at guides 41 by a take-off roller 42, against which a pressure roller 43 holds the material web, and is fed by further guides 44, 47 to the channel of the guide 50 (FIG. 2). The take-off roller 42 is driven by a stepping motor 54; which in clocked synchronism advances the required length of the material web. Through actuation of a top cutter 45, which operates towards a bottom cutter 46, the appropriate portion is cut from the material web.

The guide 47 is capable of swivelling about a fixed fulcrum and is moved by a pneumatic cylinder 48 back and forth between an upper position, in which it guides the material web into the guide 50, and a lower position, in which it guides the cut-off spine insert 3 while the latter is being pushed to the joining point 8. Upon swivelling into the lower position, the cut-off end of the flexible spine insert 3 is pressed into the guide 50. The guide 47 remains in the lower position when the rigid spine inserts 7 are to be processed.

For processing the rigid spine insert 7 a board screening feed hopper 30 is provided, which is situated above the intermediate station, into which the first board pusher 25 advances the cover boards 2. The board screening feed hopper 30 has a format-defined reference edge 30*a*, which is identical with the leading edge of the cover boards 2 advanced into the intermediate station. The rigid spine inserts 7 are stacked one on top of the other in the board screening feed hopper 30 and aligned at front and rear stops 31, 32, wherein the rear stops are arranged so as to be adjustable in relation to the height of the rigid spine insert 7. Jointly with the cover boards 2 a rigid spine insert 7 decollated from the board screening feed hopper 30 is fed by the second board pusher 26 to the joining point 8. The rigid spine insert 7 is in said case advanced in guides 51, 52*b*.

The board feed, which is represented in the drawings substantially by the board pushers 25, 26, which are moved forwards and backwards by the toothed belt 24, and by the guides 50, 53, is disposed so as to ascend in board feed direction relative to the horizontal foot print of the machine. The prestacking belt 21 is therefore at approximately the same height level as the horizontally disposed covering material feed 10, which feeds the covering material 4 under the covering material drum 11, with the result that ergonomic lay-on heights both for laying-on of the cover boards 2 and also for the covering material 4 stocked in a feed hopper may be achieved.

What is claimed is:

1. Apparatus for feeding spine inserts in a machine for manufacturing book covers from book boards, covering material and screening, the machine including a gluing mechanism for coating the covering material with glue, the apparatus comprising:

a first cutting device adapted for forming a material web by cutting the screening to a predetermined width;

a second cutting device adapted for cutting off a portion of the material web to form a flexible spine insert;

a board feed defining a board feed plane, the board feed being adapted for pushing the spine inserts and cover boards and for synchronous feeding of the boards in a board feed direction onto the glue coated covering material; and a take-off roller system adapted for advancing the material web into the board feed plane in clocked synchronism and in a direction counter to the board feed direction, the take-off roller system including first guide means for guiding the material web and second guide means for guiding the flexible spine insert until the flexible spine insert is situated entirely in the board feed plane.

2. Apparatus according to claim 1 wherein the second guide means includes moveable guides which press the cut-off end of the flexible spine insert into the board feed plane.

3. Apparatus according to claim 1 wherein each flexible spine insert has oppositely disposed outer edges and the second guide means includes at least one driven roller pairs, the driven roller pairs grasping the flexible spine insert at the outer edges and conveying the flexible spine insert into the board feed plane, each driven roller pair including first and second separable rollers, whereby the flexible spine insert may be freely pushed therebetween during feeding of the boards onto the covering material.

4. Apparatus according to claim 1 further comprising a board feed hopper for receiving the book boards, the take-off roller system is disposed upstream of the board feed hopper, the flexible spine insert being pushed between the take-off roller system and the board feed hopper.

5. Apparatus according to claim 4 further comprising a board screening feed hopper, the board screening feed hopper stocking and decollating rigid spine inserts, each rigid spine insert comprising a cut-to-size book board.

6. Apparatus according to claim 5 wherein the board feed feeds the cover boards and the spine insert in one stroke to a joining point.

7. Apparatus according to claim 1 wherein the board feed extends from an input point for receiving the cover boards to a joining point for joining the cover boards and spine insert with the covering material, the take-off roller system being disposed at an intermediate position between the input and joining points, the take-off roller system pushing the flexible spine insert into the intermediate position, the board feed feeding the cover boards from the input point to the intermediate position in a first stroke and feeding the cover boards and flexible spine insert from the intermediate position to the joining point in a second stroke.

8. Apparatus according to claim 7 wherein further comprising a board screening feed hopper disposed proximate to the intermediate position, the board screening feed hopper stocking and decollating rigid spine inserts, each rigid spine insert comprising a cut-to-size book board.

9. Apparatus according to claim 8 wherein the take-off roller system further includes third guide means for guiding the spine insert and cover boards from the intermediate position, the third guide means comprising interchangeable rigid spine and flexible spine guides.

10. Apparatus according to claim 1 wherein the take-off roller system further includes a take-off roller, a pressure roller, and a stepping motor driving the take-off roller.

11. Apparatus according to claim 7 wherein the board feed plane ascends from the input point to the joining point.

* * * * *